US005417194A

United States Patent [19]

Augustin

[11] Patent Number: 5,417,194

[45] Date of Patent: May 23, 1995

[54] METHOD OF OPERATING A MULTI-CYLINDER DIESEL ENGINE

[75] Inventor: Ulrich Augustin, Kornen, Germany

[73] Assignee: Mercedes-Benz AG, Stuttgart, Germany

[21] Appl. No.: 198,582

[22] Filed: Feb. 18, 1994

[30] Foreign Application Priority Data

Mar. 1, 1993 [DE] Germany ..... 43 06 252.0

[51] Int. Cl.[6] ..... F02D 41/22; F02D 41/38

[52] U.S. Cl. ..... 123/456; 123/479

[58] Field of Search ..... 123/479, 359, 456

[56] References Cited

U.S. PATENT DOCUMENTS 4,941,445 7/1990 Deutsch ..... 123/479

FOREIGN PATENT DOCUMENTS 0501459 9/1992 European Pat. Off. .

60-43147 3/1985 Japan ..... 123/359

OTHER PUBLICATIONS

MTZ Motortechnische Zeilschift 49 (1988) 1, Digitale Diesel Elektronik beim BMW-Turbodiesel Modell 324 1-d. by Gerd Schwarzbouer and Helmut Weiss (mounth unknown).

ATZ Automobiltechnische Zeitschrift 91 (1989) 4, Möglichkeiten zur Komfortverbesserung durch Einsatz der Digitalen Diesel-Elektronik by G. Pabinger and J. Wolkerstorfer (no unknown).

Mot-Technik, Mar. 5, 1988, Neue Dimensionen-Digitale Dieselemspritzung by Olaf von Fersen.

*Primary Examiner*—Andrew M. Dolinar

*Attorney, Agent, or Firm*—Klaus J. Bach

[57] ABSTRACT

In a method of operating a multi-cylinder Diesel engine in which fuel delivered by an engine-driven high-pressure pump is supplied to a high-pressure line from where it is admitted through injectors to the associated cylinders by an engine speed synchronous pulse and the pressure in the fuel line is determined by a pressure sensor at a certain operating point present during fuel delivery and, upon failure of the synchronous pulse, a pressure signal generated at this operating point is used to start the injection sequence with the activation of one of the injectors, and the time spans between subsequent operating points in the injection sequence are determined and, if a deviation between the time spans exceeds a limit value, another injector is selected for the start of another injection sequence, which is used as a new start of the injection sequence until the time spans between the various operating points in the high-pressure fuel supply lines which are a measure for engine speed are essentially the same.

1 Claim, 2 Drawing Sheets

METHOD OF OPERATING A MULTI-CYLINDER DIESEL ENGINE

BACKGROUND OF THE INVENTION

The invention relates to a method of operating a multi-cylinder Diesel engine with electronically controlled injection timing valves.

Such methods are known, for example, from EP 0 501 459 A2 wherein fuel under high pressure is delivered by a high-pressure pump, which is configured as a piston pump, into a common rail (high-pressure reservoir) provided for all the nozzles and is supplied to the nozzles, which are controlled by magnetic valves in a manner taking into account a certain injection sequence.

Activation of a particular nozzle is associated with a certain cylinder of the multi-cylinder internal combustion engine by means of a synchronous pulse.

An electronic control unit, by which all nozzles can be activated in the correct sequence, has the proper injection sequence and ignition sequence stored in its memory. If there is a fault in, or total failure of, engine speed synchronized pulses, correct association of the injection pulses for a particular nozzle with a particular cylinder is no longer guaranteed during the operation of the internal combustion engine or during starting of the internal combustion engine with such an injection system operating in accordance with such a high-pressure reservoir principle.

The object of the present invention is, therefore, to eliminate this disadvantage by means of simple measures which will permit provisional operation of the internal combustion engine in such an emergency driving situation.

SUMMARY OF THE INVENTION

In a method of operating a multi-cylinder Diesel engine in which fuel delivered by an engine-driven high-pressure pump is supplied to at least one high-pressure line common for all cylinders from where it is admitted under magnetic valve control in accordance with a certain injection sequence, through injectors to the associated cylinders by an engine speed dependent synchronous pulse coordinating injection timing for the injector of a predetermined cylinder, and in which, furthermore, the fuel pressure generated in the high-pressure fuel line by an engine-driven high-pressure fuel supply pump with a fuel delivery event is determined by a pressure sensor and, on deviation from a required value, is readjusted, the pressure value in said fuel line is determined by the pressure sensor at a certain operating point present during the delivery and, upon failure of the synchronous pulse, a pressure signal generated at this operating point is used to start the injection sequence with the activation of one of the injectors, wherein, at the same time the time spans between this operating point and the next operating points in the injection sequence are determined and, if a deviation between the time spans exceeds a limit value, another injector is selected for the start of another injection sequence, which is used as a new start of the injection sequence until the time spans between the various operating points in the high-pressure fuel supply lines which are a measure for engine speed are essentially the same.

In this manner, total failure of the Diesel engine can be avoided and further operation can be maintained for emergency operation by recording at least two time spans or time intervals of an injection sequence between respective deliveries of the high-pressure pump, starting from an arbitrarily chosen injection event for an injector of a particular cylinder, and, in the case of an excessive deviation between two time spans as an indication of rough engine operation, repeating this procedure with an injection sequence starting with another, preferably the next, cylinder in the injection sequence. If then two newly determined time intervals are the same, the engine runs smoothly, that is, the correct nozzles are associated with the respective cylinders and the engine can then continue to operate with a pressure signal substituted for the engine speed signal until the system can be repaired.

DESCRIPTION OF A PREFERRED EMBODIMENT

Figure 1:
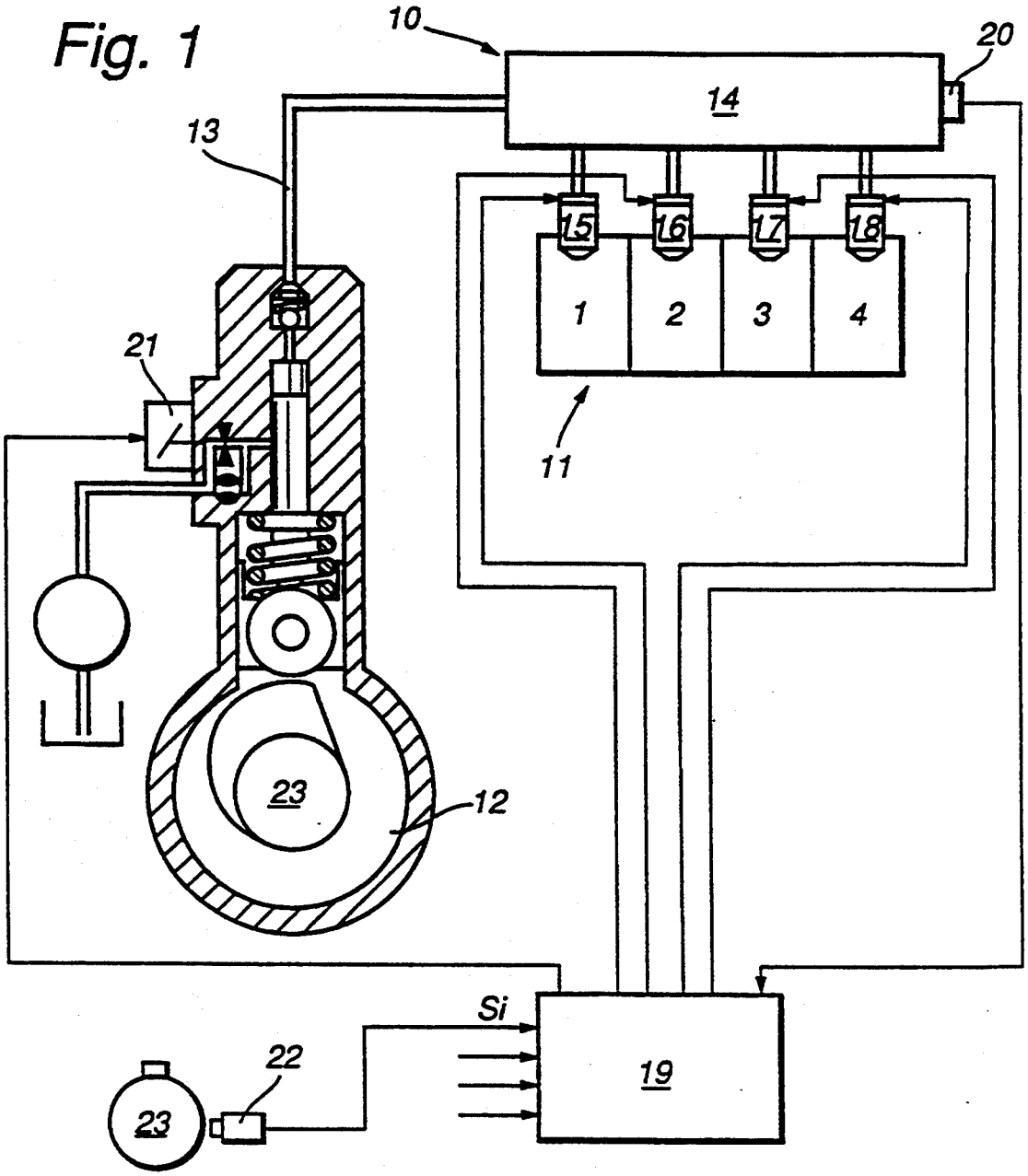
FIG. 1 shows a fuel injection system with a common high-pressure fuel supply line.

In accordance with FIG. 1 the invention is explained on the basis of a fuel injection system 10 top a four-cylinder Diesel engine 11.

The fuel injection system 10 consists of an engine-driven high-pressure pump 12, configured as a demand-controlled piston pump, and of an injection conduit system 13 with a common high-pressure fuel supply line 14 for all the injectors 15, 16, 17, 18, which are controlled by magnetic valves and are associated with predetermined cylinders 1, 2, 3, 4 of the Diesel engine 11.

Each of the injectors 15–18 can be activated by an electronic control unit 19.

A pressure sensor 20, which senses the actual pressure is provided on the high-pressure line 14. When there is a deviation from the pressure required for operation of the system, the high-pressure pump 12 is readjusted, by means of the electronic control unit 19 and an adjusting element 21 on the high-pressure pump, until the desired pressure level is achieved.

In addition to the pressure sensor 20, a cylinder identification sensor or synchronous pulse sensor 22 is provided which, in association with a marking on the camshaft 23, coordinates the injection of each injector 15, 16, 17 or 18 with a particular cylinder 1, 2, 3 or 4 in the injection sequence which is known to the computer in the control unit.

Figure 3:
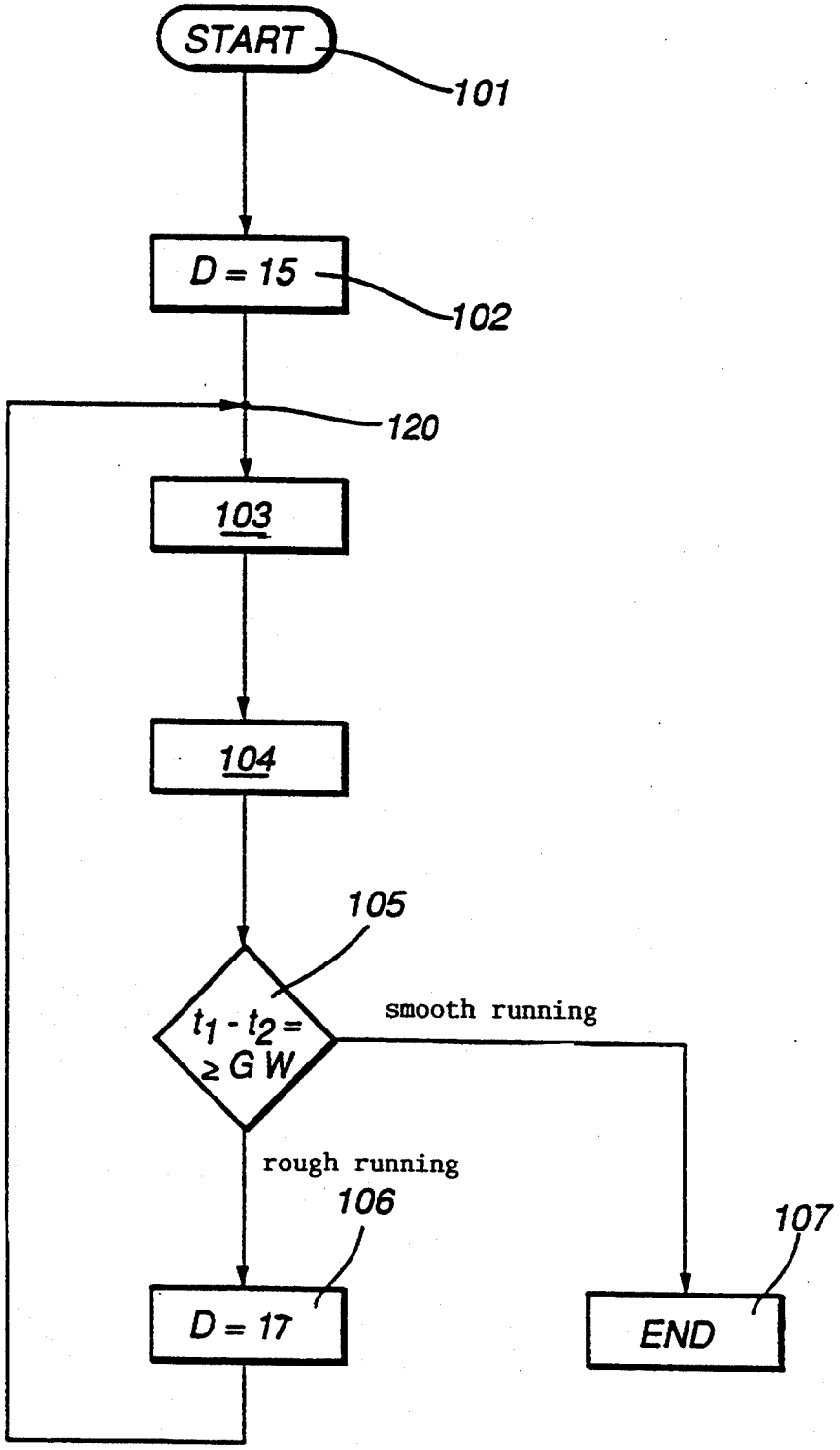
FIG. 3 represents a flow diagram showing the operation of the electronic control unit.

The pressure sensor 20 used in the fuel injection system 10 is not only used to adjust the high-pressure control circuit in order to maintain a certain pressure level in the high-pressure conduit system. It also senses the pressure pulses generated in the high-pressure fuel supply line by the fuel delivery events of the engine-driven high-pressure fuel pump 12 which in the given example is coupled to the camshaft 23 and has four cylinders for sequential fuel delivery events per rotation. In the case or a fault in, or failure of, the synchronous pulse sensor 22, the pressure sensor 20 is also used to maintain an emergency driving capability, which is described in greater detail below using the flow diagram shown in FIG. 3.

After the multi-cylinder internal combustion engine 11, that is, a four-cylinder engine, has been started in block 101, one of the four injectors 15, 16, 17, 18 with an injection sequence corresponding to a cylinder ignition sequence 1', 3', 4', 2' of the cylinders 1, 2, 3, 4, namely the injector nozzle 15, is first selected in block 102 for activation in block 103.

Figure 2:
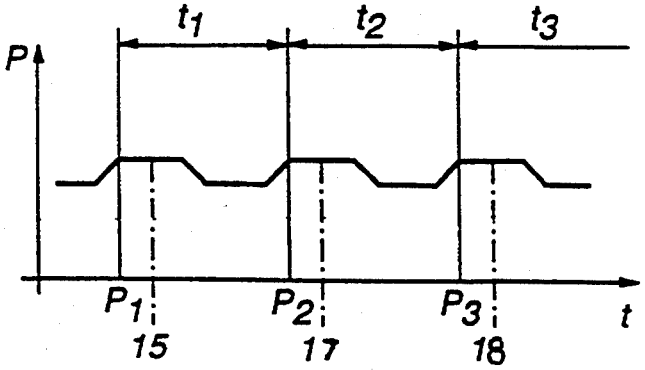
FIG. 2 shows, as a pressure/time diagram, the pressure variation present in the common high-pressure fuel supply line.

Starting with a reference signal which corresponds to the pressure value $P_1$ of a certain operating or starting point in the pressure curve of FIG. 2 between two deliveries of the high-pressure pump 12, the time interval or the time span $t_1$ between these two deliveries of the nozzles 15 and 17 and the time span $t_2$ between two deliveries of the nozzles 17 and 18 in the injection sequence are recorded in block 104.

The sensed values of $t_1$ and $t_2$ are checked in the branch block 105. An incorrect starting point for the injection sequence will be apparent by a large fluctuation in the times $t_1$ and $t_2$ between the respective deliveries, by a decrease in engine rpm or by violent shaking of the engine. If, therefore, the difference or deviation between $t_1$ and $t_2$ is greater than a specified limit value GW, the injector of the incorrect cylinder has been addressed in block 103.

If, with the selection of the starting point for a particular sequence, the engine is not running smoothly, the next injector following the nozzle 15 in the injection sequence, that is, nozzle 17 is selected in block 106 for starting the injection sequence. Control is returned to the point 120 for renewed activation of a nozzle, namely nozzle 17 for the start of a new injection sequence.

The individual steps are repeated until it can be assumed that the deviation between two further time spans, for example, between $t_2$ and $t_3$, is not larger than a specified limit value GW. The internal combustion engine should then be running smoothly and it is then assumed that the system has associated the correct injectors with the particular cylinders. The rotational speed fluctuations, and therefore the times between the deliveries, are at least approximately constant.

The injection system and the internal combustion engine are synchronized after just a few revolutions of the engine.

The electronic control unit checks the running smoothness, that is, engine speed fluctuations at regular intervals and, if necessary, undertakes a correction.

With the system described a Diesel engine with electronically controlled fuel injectors, which normally needs a crankshaft or camshaft rotational position identification signal for proper identification of the appropriate injectors to be addressed for timely fuel injection into the associated cylinders, can be operated even if the shaft position identification signal is not available. With substitution of a fuel pressure pulse signal and the capability of selecting the appropriate cylinder for the start of the injection sequence in accordance with the method according to the invention the appropriate injection sequence is rapidly associated with the respective cylinders for continued engine operation.

What is claimed is:

1. A method of operating a multi-cylinder Diesel engine in which fuel is delivered by an engine-driven high-pressure pump to a common high-pressure supply line in which, with the pump deliveries, a series of pressure pulses with engine speed dependent time spans therebetween is generated in said high-pressure supply line and the fuel is admitted from said high-pressure supply line via injectors to the various cylinders under the control of magnetic valves in accordance with a predetermined injection sequence, which is initiated by an engine speed-synchronous pulse with which an injection event for a predetermined cylinder is associated and wherein the fuel pressure in said common high-pressure line during a predetermined pump delivery point is determined by a pressure sensor and, upon deviation from a set pressure value, is adjusted by means of an electronic control unit, said method, upon failure of said engine speed synchronous pulse, comprising the steps of: substituting a pressure pulse signal generated by said pressure sensor at said predetermined pump delivery point for said speed-synchronous pulse, activating one of said injectors and, in injection sequence, the other injectors for the sequential injection of fuel into the respective cylinders, determining the time span between the pressure pulse signals activating said one injector and the time spans between the following pressure pulse signals, comparing two of said time spans between consecutive pressure signals, and, if the difference between the two time spans exceeds a limit value, beginning the following injection sequence with the injector for another cylinder until the difference between the time spans measured with the beginning of said following injection sequence is less than said limit value as an indication that the proper assignment of injector and cylinder has been found allowing for smooth engine operation.

* * * * *